United States Patent [19]

Lishness et al.

[11] Patent Number: 5,058,301

[45] Date of Patent: Oct. 22, 1991

[54] REVERSIBLE MAGAZINE CATCH ASSEMBLY AND METHOD OF MAKING THE SAME

[75] Inventors: Bryant L. Lishness, Bristol; Paul A. Scirica, East Hampton, both of Conn.

[73] Assignee: Colt's Manufacturing Company Inc., West Hartford, Conn.

[21] Appl. No.: 627,320

[22] Filed: Dec. 14, 1990

[51] Int. Cl.[5] ..... F41A 9/61

[52] U.S. Cl. ..... 42/7

[58] Field of Search ..... 42/7

[56] References Cited

U.S. PATENT DOCUMENTS

| | | | |
|---|---|---|---|
| 984,519 | 2/1911 | Browning | 42/7 |
| 1,397,109 | 11/1921 | Pedersen | 42/7 |
| 2,139,203 | 12/1938 | Petter | 42/4 |
| 4,031,648 | 6/1977 | Thomas | 42/70 A |
| 4,236,337 | 12/1980 | Beretta | 42/7 |
| 4,245,418 | 1/1981 | Kennedy | 42/7 |
| 4,326,353 | 4/1982 | Ludwig et al. | 42/7 |
| 4,420,899 | 12/1983 | Bourlet et al. | 42/70 A |
| 4,449,311 | 5/1984 | Giragssian | 42/7 |
| 4,521,985 | 6/1985 | Smith et al. | 42/7 |
| 4,539,770 | 9/1985 | Bornancini | 42/7 |
| 4,573,280 | 3/1986 | Malhorta | 42/7 |
| 4,599,818 | 7/1986 | Fedora et al. | 42/7 |
| 4,768,301 | 9/1988 | Thomas | 42/7 |
| 4,899,476 | 2/1990 | Hindle | 42/7 |

*Primary Examiner*—Charles T. Jordan

*Attorney, Agent, or Firm*—Perman & Green

[57] ABSTRACT

A reversible magazine catch assembly has a housing, a movable mounting pin and a coiled spring. The housing has a spring channel generally perpendicular to and intersecting a pin hole, and a magazine locking rib. The spring channel is formed by drilling three parallel holes into the housing at different directions to provide lateral support for the coiled spring. The spring biases the housing relative to the pin and forms a slidable friction hold of the pin. The pin has ledges that interact with the spring and housing to prevent it from being pushed out of the housing.

20 Claims, 1 Drawing Sheet

REVERSIBLE MAGAZINE CATCH ASSEMBLY AND METHOD OF MAKING THE SAME

BACKGROUND OF THE INVENTION

1. Field of the Invention

The present invention relates to firearms and, more particularly, to a magazine catch assembly for use in a firearm.

2. Prior Art

In the past, automatic and semi-automatic firearms have been used with removable cartridge magazines. These magazines are temporarily connected to the frame of the firearm by a catch assembly. The catch assembly usually has a button that is depressed or moved to release the magazine from the firearm. U.S. Pat. No. 984,519 to Browning discloses a transversely mounted magazine catch with a projecting lug that prevents its housing from turning and a spiral spring and piston. U.S. Pat. No. 4,326,353 to Ludwig et al. discloses a magazine catch release operable from both sides of a pistol. Other U.S. Patents that disclose magazine catches include U.S. Pat. Nos. 2,139,203; 4,031,648; and 4,420,899. Reversible magazine catches that can be reversed for use with either a right or left handed user are also known to exist in the prior art.

A problem exists with the prior art in that no adequate reversible magazine catch has been provided that is relatively easy to manufacture and assemble, and does not easily disassemble when removed from the frame of the firearm.

It is therefore an objective of the present invention to overcome problems in the prior art as well as provide additional features and advantages.

SUMMARY OF THE INVENTION

The foregoing problems are overcome and other advantages are provided by a new and improved magazine catch assembly and method of manufacturing the same.

In accordance with one embodiment of the present invention, a magazine catch assembly is provided comprising a housing, a mounting pin, and a coiled spring. The housing has a pin hole, a spring channel generally perpendicular to and intersecting the pin hole, and a magazine locking rib. The spring channel is formed from at least three interconnected holes transverse to a path of the channel. The mounting pin is movably located in the pin channel for movement in two perpendicular paths. The coiled spring is located in the spring channel with a first end adjacent a portion of the housing and a second end adjacent the pin. The spring channel provides lateral support for the spring. The spring is adapted to friction hold the pin relative to the housing, but the housing and pin can be moved relative to each other without substantial risk of disassembly of the assembly.

In accordance with one method of the present invention, a method of manufacturing a magazine catch assembly for use in a firearm is provided. The method comprises steps of forming a push button housing with a spring channel and a mounting pin channel transverse to the spring channel. The spring channel is comprised of at least three interconnected holes. The method further comprises inserting a coiled spring in the spring channel, and inserting a mounting pin into the mounting pin channel with the coiled spring thereagainst wherein the mounting pin is adapted to move in the pin channel in two paths.

In accordance with another embodiment of the present invention, a firearm having a frame with a magazine receptacle, a barrel, a slide, a firing mechanism, and a reversible magazine catch assembly is provided. The magazine catch assembly comprises a button housing, a coiled spring, a mounting pin, and means for preventing the spring from inadvertently being pushed out of the button housing. The button housing has a first channel, a transverse second channel, and a magazine locking section. The coiled spring is located in the first channel. The mounting pin is movably mounted in the second channel with the spring thereagainst. The pin has a first ledge on a first end and a second ledge on a second end. The ledges are generally angularly offset from each other about a center axis of the pin to prevent the pin from being inadvertently pushed out of the second channel.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
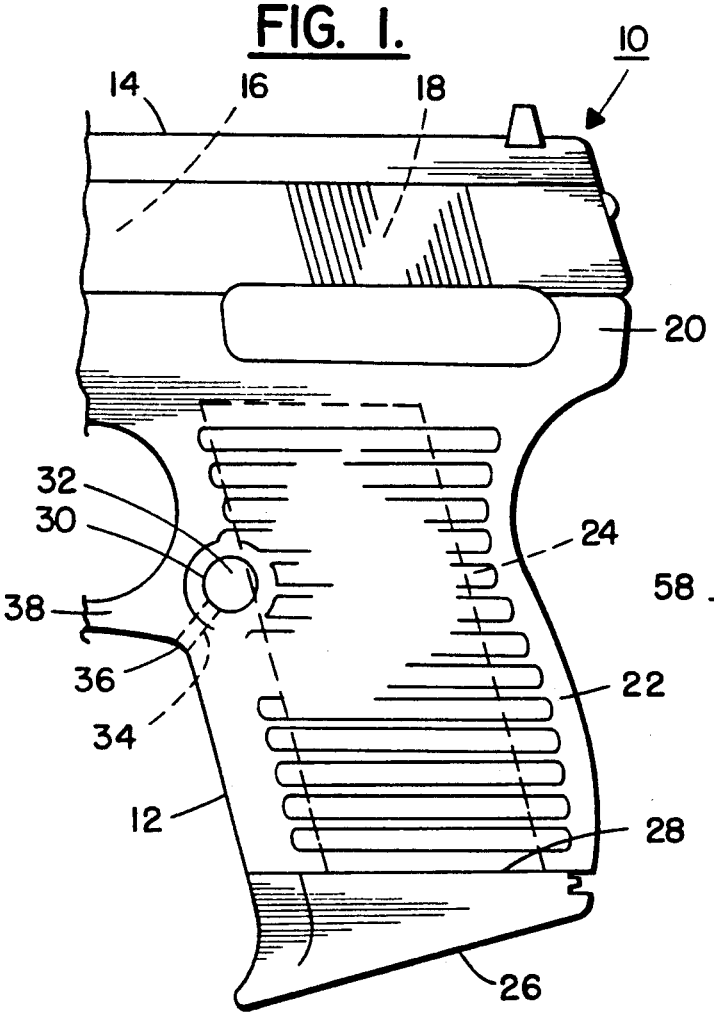
FIG. 1 is a partial plan side view of the rear of a pistol incorporating features of the present invention.
Figure 4:
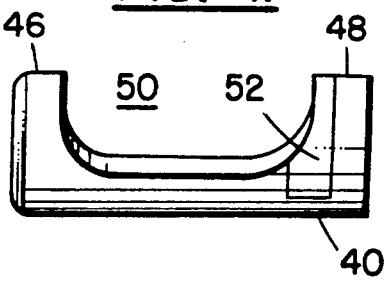
FIG. 4 is a plan perspective top view of the housing shown in FIG. 2.

Referring to FIG. 1, there is shown a partial plan side view of the rear end of a semi-automatic pistol 10 having a reversible magazine catch assembly 32 incorporating features of the present invention. Although the present invention will be described with reference to the embodiment shown in the drawings, it should be understood that the present invention can be incorporated into different types of embodiments and may be used with different types of firearms and in conjunction with different features of a firearm. In addition, any suitable size, shape and type of elements or materials could be used.

The pistol 10 generally comprises a frame 12, a slide 14, a barrel 16 under the slide, and a firing mechanism 18 in the frame. The pistol 10 is similar to a pistol disclosed in U.S. patent application Ser. No. 447,601 filed Dec. 8, 1989 which hereby is incorporated by reference in its entirety. The frame 12 may be comprised of any suitable material such as metal or plastic. In the embodiment shown, the frame 12 has a top section 20 on which the slide 14 can slide. The frame 12 also forms a pistol grip section 22. The pistol grip section 22 may be comprised of a portion of the frame 12 and removable pistol grip sides made of wood or any suitable material. Alternatively, such as when the frame 12 is made of plastic, the pistol grip section can be a unitary section. The pistol grip section 22 comprises an interior magazine channel or receptacle 24 which is adapted to removably receive cartridge magazine 26. The magazine receptacle 24 extends the length of the pistol grip section 22 from its bottom 28 up to the top section 20 of the frame 12. The pistol grip section 22 also comprises a button hole 30 that transversely extends through the pistol grip section 22 between its two sides and partially intersects the magazine receptacle 24. Removably mounted in the hole 30 is a reversible magazine catch assembly 32. In the embodiment shown, the pistol grip section 22 also comprises a retaining pin hole 34 that transversely extends from the middle of the hole 30 to an opening 36 under the trigger guard 38.

Referring now also to FIGS. 2–7, the catch assembly 32 will be described. The catch assembly 32 generally comprises a button housing 40, a retaining pin 42, and a coiled spring 44. The housing 40 is made of a suitable material such as metal or plastic and generally comprises a first end 46, a second end 48, a U-shaped recess 50 with a keying portion or locking rib 52, spring channel 54, and a pin hole 56. As can be seen, in the embodiment shown, the housing 40 has a general circular side profile. The two ends 46 and 48 are intended to be positioned at the opposite openings to the hole 30. The first end 46 is intended to be the push button side of the assembly 32 as will further be understood below. The keying portion or locking rib 52 comprises a portion of the housing 40 being cut away such that the locking rib 52 can be inserted into a notch in the front side of the cartridge magazine 26. The cartridge magazine 26 has two locking rib openings in its front, one on each side such that the magazine 26 can be used with the pistol 10 with the catch assembly 32 being in either of its right or left handed configuration. The U-shaped recess 50 is substantially the same size and shape of the front end of the cartridge magazine 26, or at least is suitably sized and shaped to allow the cartridge magazine 26 to be positioned in the magazine receptacle 24 with a portion of the magazine 26 being located in the U-shaped recess 50.

The spring channel 54, in the embodiment shown, is comprised of three parallel holes 58, 59, and 60 that have been drilled into the housing 40 perpendicular to the path of the spring channel 54. The first and third holes 58 and 60, in the embodiment shown, are blind holes that extend into the housing 40 in a first direction. The second hole 59, in the embodiment shown, is also a blind hole located between the first and second holes 58 and 60 and extending into the housing 40 in a direction opposite the first and second holes 58 and 60. However, any suitable angles or orientations of the holes, and any suitable number of holes, may be provided to establish the spring channel.

The pin hole 56, in the embodiment shown, extends all the way through the housing 40 from a first side inside the U-shaped recess 50 to the opposite second side. The pin hole 56 transversely intersects the spring channel 54 at an end of the spring channel approximate the third hole 60 and has an irregular shaped opening approximate the U-shaped recess 50. The irregular opening 62 has a length longer than the width of the pin 42 with a curve side on one end, a width substantially the same height as the pin 42, and a depth shorter than the length of the pin 42.

The retaining pin 42 is made of a suitable material such as metal or plastic and comprises a first end 64, a second end 66, a first ledge 68 located at the first end 64, and a second ledge 70 located at the second end 66. In the embodiment shown, a side 72 from which the second ledge 70 extends is substantially flat. In the embodiment shown, the two ledges 68 and 70 are angularly offset relative to each other along the center axis of the pin 42 approximately 90°. The side 74 from which the first ledge 68 extends has one end 78 of the coiled spring 44 positioned thereagainst. The side 74 is relatively uniformly curved, but in an alternate embodiment of the present invention, the pin 42 may include dimples 76 that cooperate with the end of the spring 44 to act as positive detents in positioning the pin 42 relative to the spring 44. In the embodiment shown, the height of the pin 42 measured from side 72 to its opposite side is substantially the same as the width of the hole 56. The flat side 72 is positioned adjacent a flat side of the pin hole 56 such that the pin 42 is prevented from axially rotating relative to the housing 40.

The spring 44 is generally comprised of an elongate coiled member made of a suitable material such as metal with a general tubular or column shape. The spring 44 has a first end 78 positioned adjacent the pin side 74 and a second end 80 positioned adjacent the housing 40 in the first hole 58. The spring 44 is located in the spring channel 54 and slightly compressed between its two ends 78 and 80. Thus, the spring 44 biases the pin 42 against the curved wall inside the pin hole 56. Due to the unique configuration of the spring channel 54 being formed from three parallel holes drilled into the housing 40, the spring channel 54 has lateral support on all sides without having to drill through the first or second ends 46 and 48 of the housing, thus preserving a clean uniform surface at the ends 46 and 48 while nonetheless providing appropriate lateral support for the spring 44 in the spring channel 54.

In order to assemble the magazine catch assembly 32, the pin 42 is first inserted into the housing 40 via the pin hole 56. The first end 64 of the pin 42 must first be inserted through the pin hole 56. The movement of the pin 42 through the housing 40 will be stopped when the second ledge 70 contacts the housing 40. The spring 44 can then be inserted and compressed into the spring channel 54 and positioned below the first ledge 68 and released onto the second side 74 of the pin 42. This completes assembly of the catch assembly 32. With the catch assembly 32 assembled, the pin 42 is movable in two separate paths which are perpendicular to each other. The first path is a path along the pin's longitudinal axis. The second path is perpendicular to the pin's longitudinal axis and parallel to the center axis of the spring channel 54.

Figure 5:
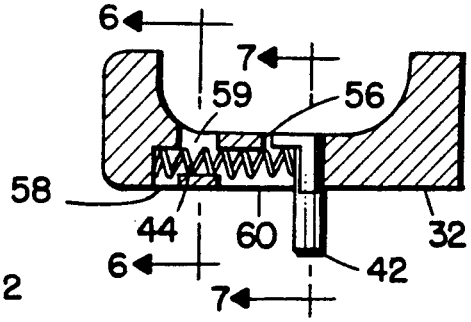
FIG. 5 is a cross sectional view of the assembly shown in FIG. 2.
Figure 6:
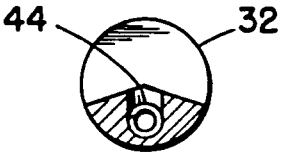
FIG. 6 is a cross sectional view of the assembly shown in FIG. 5 taken along line 6—6.
Figure 7:
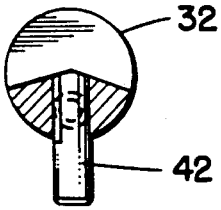
FIG. 7 is a cross sectional view of the assembly shown in FIG. 5 taken along line 7—7.
Figure 2:
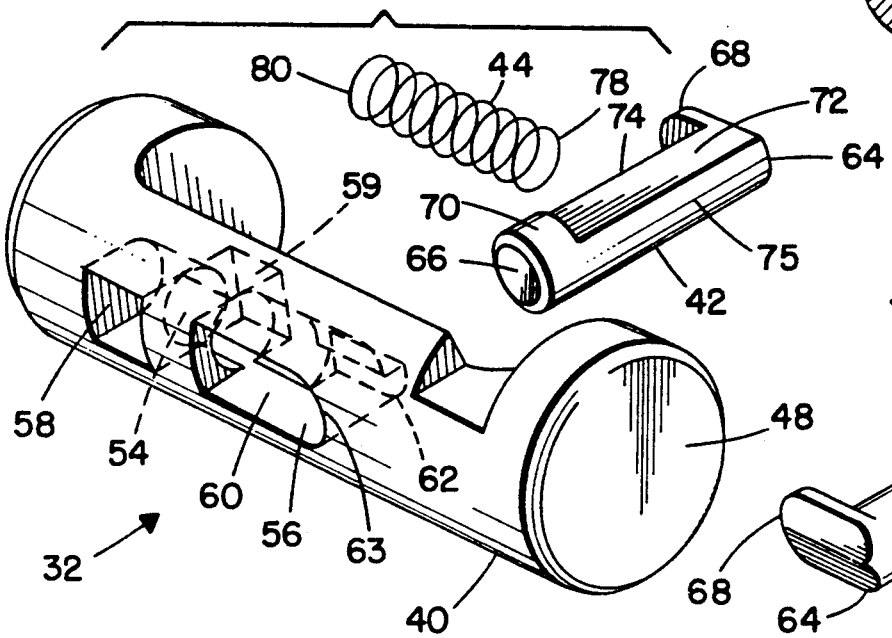
FIG. 2 is an exploded perspective view of a reversible magazine catch assembly incorporating features of the present invention.
Figure 3:
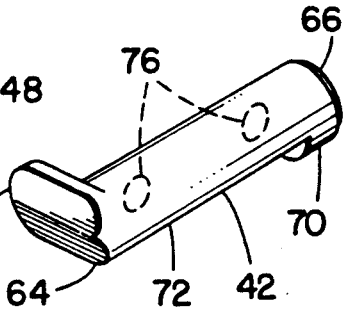
FIG. 3 is a perspective view of the pin of the assembly shown in FIG. 2.

The movement of the pin 42 in its first path is for removably mounting the assembly 32 to the frame 12 in hole 30. In order to insert the assembly 32 into the hole 30, the pin 42 is positioned at a first position relative to the housing 40 wherein the first end 64 of the pin 42 projects in the recess 50, the curved wall 63 in the pin hole 56 has the wall 75 of the pin 42 thereagainst, and the side profile of the assembly 32 is circular without the pin 42 being seen projecting out from that profile. The assembly 32 can thus be inserted into the hole 30. Once positioned in the hole 30, with the pin 42 aligned with the pin hole 34, the assembler can insert his finger up the open magazine cavity 24 and push on the first end 64 of the pin to move the pin 42 along its first path into the pin hole 34. The advancement of the pin 42 is stopped when the second ledge 70 contacts the spring 44. The pin 42 is thus positioned in its second position relative to the housing 40 as shown in FIGS. 5 and 7. With the pin 42 in its second position relative to the housing 40 and projecting into pin hole 34, the pin 42 prevents the housing 40 from axially rotating inside the assembly hole 30. In addition, because the housing 40 and pin 42 are biased against each other with the pin 42 in its first path, the pin 42 positions the housing 40 in a home longitudinal position in the assembly hole 30. In this home position, the locking rib 52 projects into the magazine cavity 24 such that it can operably engage a magazine. No other additional steps to mount the assembly 32 in the frame 12 are necessary.

The use and operation of the assembly 32 is a push button type of action. When a user loads a magazine into the magazine receptacle 24, a top edge of the magazine 26 contacts the housing 40 inside the cavity 24 and automatically cams or wedges the housing 40 in a direction towards its second side 48. Because the length of the pin hole 56 is longer than the width of the pin 42, the pin 42 remains stationary relative to the frame 12 and the housing 40 can move relative to the pin 42 with the pin 42 laterally sliding in the pin hole 56 along its second path. The spring 44 merely compresses during this relative movement. The leading edge of the magazine 26 is thus able to pass beyond the assembly 32. The magazine 26 stops when the locking rib 52 comes into registry with the locking hole in the front of the magazine, at which point, because the magazine 26 no longer cams against the housing 40, the spring 44 biases the housing 40 back to its home position with the locking rib 52 moving into the locking hole of the magazine 26. The magazine 26 is thus connected to the frame 12 and cannot be removed unless the housing 40 is intentionally moved by the user to move the locking rib 52 out of the magazine locking hole. This intentional disconnection is accomplished by the user merely pushing on the housing first end 46 which, in turn, laterally moves the housing 40 in the hole 30 with the pin 42 sliding in the pin hole 56. Release of the pressure on the housing first end 46 results in the spring 44 returning the housing 40 back to its home position.

As noted above, the assembly 32, in the embodiment shown, is a reversible assembly intended to be used with either a right handed or left handed user. Thus, the housing first side 46, that is intended to be depressed by the user, can be positioned on either the right or left side of the pistol 10. Ordinarily, the pistol 10 would be shipped from the manufacturer with the housing first side 46 located on the right side of the pistol 10. In order to reconfigure the pistol for a left handed shooter, or for cleaning or repair, a tool such as a thin rod would be positioned through the pin hole aperture 36, into the pin hole 34, and against the second end 66 of the pin 42. By pushing on the second end 66 of the pin 42 with the tool, the pin 42 can be moved along its first path back to its first position. The contact of the second ledge 70 with the housing 40 prevents the pin 42 from being pushed out of the housing 40. With the pin 42 out of the pin hole 34, the assembly 32 can be laterally removed from the frame 12. After cleaning, repair, or reversal, the assembly 32 can be reinserted into the frame 12 and reconnected therewith. When removed from the frame 12, the duel ledge configuration of the pin 42 and the laterally supported or keyed configuration of the housing 40 that establishes the spring channel 54 cooperate to prevent the assembly from becoming inadvertently disassembled.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A magazine catch assembly comprising:

a housing having a pin hole, a spring channel generally perpendicular to and intersecting said pin hole, and a magazine locking rib, said spring channel being formed from at least three interconnected holes transverse to a path of said channel;

a mounting pin movably located in said pin hole in two perpendicular paths; and a coiled spring located in said spring channel with a first end adjacent a portion of said housing and a second end adjacent said pin wherein said spring channel provides lateral support for said spring, said spring is adapted to friction hold said pin relative to said housing, and said housing and pin can be moved relative to each other without substantial risk of disassembly of the assembly.

2. An assembly as in claim 1 wherein said interconnected holes that form said spring channel are blind holes.

3. An assembly as in claim 2 wherein at least two of said interconnected holes that form said spring channel are in different directions into said housing.

4. An assembly as in claim 3 wherein said interconnected holes comprise two holes in one direction into said housing and one hole between said two holes in a different direction into said housing.

5. An assembly as in claim 1 wherein said pin has two ledges on opposite ends thereof to prevent said pin from being pushed through said housing.

6. An assembly as in claim 5 wherein one of said ledges is adapted to contact said spring and one of said ledges is adapted to contact said housing.

7. An assembly as in claim 6 wherein said ledges are oriented about 90 degrees offset from each other about a center axis of said pin.

8. A method of manufacturing a magazine catch assembly for use in a firearm, the method comprising steps of:

forming a push button housing with a spring channel and a mounting pin channel transverse to the spring channel, the spring channel being comprised of at least three interconnected holes;

inserting a coiled spring in the spring channel; and inserting a mounting pin into the mounting pin channel with the coiled spring thereagainst wherein the mounting pin is adapted to move in the pin channel in two paths.

9. A method as in claim 8 wherein the steps of forming the housing includes drilling the three holes into the housing parallel to each other to form the spring channel.

10. A method as in claim 9 wherein the step of forming the housing includes drilling a center hole in one direction and two holes on opposite sides of the center hole in an opposite direction to form the spring channel.

11. A firearm having a frame with a magazine receptacle, a barrel, a slide, a firing mechanism, and a reversible magazine catch assembly, the catch assembly comprising:

a button housing having a first channel, a transverse second channel, and a magazine locking section;

a coiled spring located in said first channel;

a mounting pin movably mounted in said second channel with said spring thereagainst, said pin having a first ledge on a first end and a second ledge on a second end, said ledges being generally angularly offset from each other about a center axis of said pin to prevent said pin from being inadvertently pushed out of said second channel; and means for preventing said spring from inadvertently being pushed out of said first channel.

12. A firearm as in claim 11 wherein said pin is movably mounted in said second channel in a first path between a first recessed position wherein said pin does not project past a profile of said housing, and a second extended position.

13. A firearm as in claim 12 wherein the firearm frame has a catch assembly chamber suitably sized and shaped to receive said housing therein and a pin hole adapted to receive a portion of said pin in its extended position and thereby mount the assembly in the frame.

14. A firearm as in claim 13 wherein said housing is laterally movable in said chamber, with said pin in said pin hole, to a magazine release position to move said magazine locking section, but said pin prevents said housing from being pushed out of said chamber and said spring is adapted to move said housing back to a magazine retention position.

15. A firearm as in claim 11 wherein said means for preventing includes said first channel being comprised of three interconnected holes.

16. A firearm as in claim 15 wherein at least one of said holes is a blind hole.

17. A firearm as in claim 15 wherein said holes are parallel to each other.

18. A firearm as in claim 17 wherein said holes comprise at least one hole in one direction and at least one hole in a second direction.

19. A firearm as in claim 18 wherein said holes comprise a center hole in one direction and two adjacent holes in opposite directions.

20. A firearm as in claim 11 wherein said ledges are offset about 90 degrees from each other.

* * * * *